US007667617B2

(12) United States Patent
Lo

(10) Patent No.: US 7,667,617 B2
(45) Date of Patent: Feb. 23, 2010

(54) INTERACTIVE BULLETIN BOARD SYSTEM AND METHOD

(76) Inventor: Teddy Yeung Man Lo, 19 Kent Road, Kowloon Tong, Hong Kong (CN)

( * ) Notice: Subject to any disclaimer, the term of this patent is extended or adjusted under 35 U.S.C. 154(b) by 493 days.

(21) Appl. No.: 11/510,365

(22) Filed: Aug. 25, 2006

(65) Prior Publication Data

US 2007/0008178 A1 Jan. 11, 2007

Related U.S. Application Data

(63) Continuation-in-part of application No. 10/506,058, filed on Mar. 9, 2006, now Pat. No. 7,443,315, which is a continuation-in-part of application No. 11/212,312, filed as application No. PCT/US2004/006271 on Feb. 27, 2004, now Pat. No. 7,375,650.

(51) Int. Cl.
*G08G 1/095* (2006.01)

(52) U.S. Cl. ..... 340/907; 340/929; 340/930; 362/800; 362/231

(58) Field of Classification Search ..... 340/907, 340/908, 908.1, 925, 928, 944; 362/800, 362/231
See application file for complete search history.

(56) References Cited

U.S. PATENT DOCUMENTS

| | | | | |
|---|---|---|---|---|
| 3,593,445 | A | 7/1971 | Gant | |
| 3,618,005 | A | 11/1971 | Jensen | |
| 5,014,052 | A | 5/1991 | Obeck | |
| 5,150,116 | A * | 9/1992 | West | 340/928 |
| 5,842,145 | A * | 11/1998 | Zimmer | 701/201 |
| 5,898,381 | A | 4/1999 | Gartner et al. | |
| 5,917,431 | A | 6/1999 | Sanada et al. | |
| 5,986,576 | A * | 11/1999 | Armstrong | 340/908 |
| 5,990,802 | A | 11/1999 | Maskeny | |
| 6,054,932 | A * | 4/2000 | Gartner et al. | 340/815.65 |
| 6,064,318 | A | 5/2000 | Kirchner, III et al. | |
| 6,175,313 | B1 | 1/2001 | Berezovsky | |

(Continued)

FOREIGN PATENT DOCUMENTS

| | | |
|---|---|---|
| BR | 9901803 | 1/2001 |

(Continued)

OTHER PUBLICATIONS

Apr. 4, 2008 First Office Action issued by the State Intellectual Property Office of the People's Republic of China in connection with Chinese Patent Application No. 200480003158.9.

(Continued)

*Primary Examiner*—Travis R Hunnings
(74) *Attorney, Agent, or Firm*—Dickstein Shapiro LLP

(57) ABSTRACT

A messaging board and a traffic light apparatus comprising a primary traffic panel including a first matrix of multicolored LEDs for directing motor traffic by displaying a plurality of images; a message panel including a second matrix of multicolored LEDs for displaying information unrelated to the directing of traffic; and a personal device interface providing two-way communication of information between the traffic light apparatus and at least one local user with a personal portable electronic device is disclosed. The messaging board is capable of being used as a communications station, as well as an information terminal and/or point-of-sales station.

12 Claims, 6 Drawing Sheets

U.S. PATENT DOCUMENTS

| | | | | |
|---|---|---|---|---|
| 6,317,058 | B1 | 11/2001 | Lemelson et al. | |
| 6,326,903 | B1 | 12/2001 | Gross et al. | |
| 6,331,824 | B1 | 12/2001 | Firestone | |
| 6,552,668 | B1 | 4/2003 | Berezovsky | |
| 6,710,722 | B2 | 3/2004 | Lee | |
| 6,737,983 | B1 * | 5/2004 | Temple | 340/815.45 |
| 6,788,252 | B2 | 9/2004 | Doi | |
| 6,968,362 | B2 * | 11/2005 | Koch et al. | 709/206 |
| 7,193,529 | B1 * | 3/2007 | Shah | 340/907 |
| 7,375,650 | B2 * | 5/2008 | Lo | 340/907 |
| 7,443,315 | B2 * | 10/2008 | Lo | 340/907 |
| 2002/0140604 | A1 | 10/2002 | Doi | |
| 2003/0060158 | A1 | 3/2003 | Riganati et al. | |
| 2005/0086305 | A1 * | 4/2005 | Koch et al. | 709/206 |
| 2006/0010223 | A1 * | 1/2006 | Koch et al. | 709/206 |
| 2006/0038702 | A1 * | 2/2006 | Lo | 340/907 |
| 2007/0008178 | A1 * | 1/2007 | Lo | 340/907 |

FOREIGN PATENT DOCUMENTS

| | | | |
|---|---|---|---|
| CN | 2240171 | Y | 11/1996 |
| GB | 2296121 | A | 6/1996 |
| JP | 5-189697 | A | 7/1993 |
| JP | 9-081893 | A | 3/1997 |
| JP | 11-003473 | A | 1/1999 |
| JP | 2002-286495 | A | 10/2002 |
| KR | 2001074148 | | 8/2001 |
| KR | 2002011846 | A * | 2/2002 |
| KR | 2003037703 | | 5/2003 |
| WO | WO 03058479 | A1 * | 7/2003 |
| WO | WO 2004/038685 | A1 | 5/2004 |
| WO | WO 2005/093684 | A1 | 10/2005 |
| WO | WO 2005/106823 | A1 | 11/2005 |

OTHER PUBLICATIONS

Jun. 28, 2007 Non-Final Office Action issued by the U.S. Patent and Trademark Office in connection with U.S. Appl. No. 11/212,312.

Jul. 17, 2007 PCT Notification of Transmittal of the International Search Report and the Written Opinion of the International Searching Authority, or the Declaration in connection with PCT International Application No. PCT/IB2006/003275.

Nov. 26, 2004 International Search Report issued by the International Searching Authority in connection with PCT International Application No. PCT/US04/06271.

Sep. 8, 2006 PCT Notification Concerning Transmittal of International Preliminary Report on Patentability (Chapter I of the Patent Cooperation Treaty) in connection with PCT International Application No. PCT/US2004/006271.

Feb. 19, 2009 Examiner's First Report issued by the Australian Patent Office in connection with related Australian patent application No. 2004317661.

Third Office Action dated Jun. 19, 2009 issued by The People's Republic of China Patent Office in connection with related Chinese patent application No. 200480003158.9.

Aug. 4, 2009 Office Action issued by Japanese Patent Office in connection with Japanese Application No. 2007-500736 (w/ English translation).

* cited by examiner

INTERACTIVE BULLETIN BOARD SYSTEM AND METHOD

CROSS REFERENCE TO RELATED APPLICATIONS

This application is a continuation-in-part of U.S. patent application Ser. No. 11/212,312, titled LED TRAFFIC LIGHT, filed Aug. 26, 2005, now U.S. Pat. No. 7,375,650; which is a continuation-in-part of U.S. patent application Ser. No. 10/506,058, filed Mar. 9, 2006, now U.S. Pat. No. 7,443,315, which is a §371 national stage application of PCT International No. PCT/US2004/006271, filed Feb. 27, 2004, the contents of each are incorporated herein by reference into the present application.

Throughout this application, various references may be cited. Disclosure of these references in their entirety is hereby incorporated by reference into this application to more fully describe the state of the art to which the present invention pertains.

FIELD OF THE INVENTION

The present invention relates to the field of traffic lights and messaging boards and, more particularly, to an LED messaging board.

BACKGROUND OF THE INVENTION

Traffic lights are ubiquitous from city streets to country roads. Traffic lights traditionally in the United States consist of three lights: green signifying traffic may pass, yellow signifying that traffic will soon come to a stop, and red signifying traffic must stop. These lights are generally vertically aligned, one on top of the other. In this way, traffic lights control traffic at an intersection. In other locations different conventions may be adopted, such as flashing yellow meaning traffic may pass.

Some conventional traffic lights are illuminated using incandescent light bulbs. Incandescent bulbs tend to use relatively large amounts of electricity and require periodic replacement as the bulbs burn out. These factors make the operation of incandescent traffic lights relatively expensive.

More recently, traffic lights are being illuminated using light emitting diodes (LEDs). LEDs provide a source of light that has relatively low energy consumption, and the do not burn out as easily as light bulbs.

While conventional LED traffic lights are less expensive to operate, however, they maintain the conventional approach of three lights, vertically aligned, one on top of the other. While this approach has been used for a very long time, the use of a yellow light to signify that traffic will soon come to a stop has inherent problems. Specifically, motorists approaching a yellow traffic light do not know how much longer the traffic light will continue to stay yellow. These motorists may then unnecessarily speed up creating a safety risk for other motorists and pedestrians or come to a stop unnecessarily abruptly, thereby, creating a safety risk for other motorists.

Additionally, there is a need for quick dissemination of important information to motorists and pedestrians alike. This information may concern traffic conditions ahead or it may concern instructions disseminated in the event of an emergency. Because of the ubiquity of traffic lights, they are well suited for the conveyance of important information. Conventional traffic lights, however, fail to live up to fulfilling this objective.

Furthermore, the ubiquity of traffic lights make them well suited for the conveyance of advertisements that can be tailored to the particular community in which the traffic light is located. The use of advertisements on traffic lights can deliver an aesthetically pleasing futuristic look and be an important source of additional revenue for town and city governments that are increasingly under financial pressure. Conventional traffic lights fail to live up to fulfilling these objectives as well.

Conventional bulletin boards may statically advertise products or services. Traditionally, contact information, including street addresses where such products or services could be obtained or telephone numbers where transactions could be conducted, were displayed. At present, advertisements have moved to an electronic venue, where large, television-like appliances provide information to large groups of persons, including web sites and text message numbers and codes. These device are in wide public view, however, the public has not been provided the means to interact with such display devices. Thus, there is a need for an interactive messaging board.

SUMMARY OF THE INVENTION

A messaging board and a traffic light apparatus comprising a primary traffic panel including a first matrix of multicolored LEDs for directing motor traffic by displaying a plurality of images; a message panel including a second matrix of multicolored LEDs for displaying information unrelated to the directing of traffic; and a personal device interface providing two-way communication of information between the traffic light apparatus and at least one local user with a personal portable electronic device is disclosed. The messaging board is capable of being used as a communications station, as well as an information terminal and/or point-of-sales station.

In one aspect, the present invention is directed to an interactive bulletin board system, comprising: a signal processor coupled to a computer communications network; a messaging board coupled to said signal processor, said messaging board providing visual indicia responsive to said signal processor; and a personal portable electronic device wirelessly coupled to said computer communications network; wherein said signal processor updates said visual indicia displayed on said messaging board in response to a message sent from said personal portable electronic device to said signal processor.

In another aspect of the present invention, said messaging board comprises a matrix of multicolored LEDs.

In another aspect of the present invention, the system further comprises a traffic panel including a first matrix of multicolored LEDS for directing motor traffic by displaying a plurality of images.

In another aspect of the present invention, said visual indicia represents information requested through the personal portable electronic device.

In another aspect of the present invention, said information is obtained from the Internet.

In another aspect of the present invention, said signal processor authenticates said personal portable electronic device before updating said visual indicia.

In another aspect of the present invention, said personal portable electronic device comprises a device selected from the group comprising a cellular phone, a wireless laptop, a handheld email browser, an MP3 player and a digital camera.

In another aspect of the present invention, the system further comprises a camera coupled to said signal processor, wherein said visual indicia comprises images provided by said camera.

In another aspect of the present invention, said signal processor responds to messages sent from more than one personal portable electronic device.

In another aspect of the present invention, said signal processor responds sequentially to messages received from more than one personal portable electronic device.

In another aspect of the present invention, said signal processor responds to messages received from only a single personal portable electronic device until an ending condition is met.

In another aspect, the present invention is directed to a method of displaying visual indicia on a public display, the method comprising: a processor receiving a message via a computer communications network from a personal portable electronic device wirelessly coupled to said computer communications network; and the processor updating visual indicia displayed on said display in response to said message.

In another aspect of the present invention, the method further comprises authenticating said personal portable electronic device.

In another aspect of the present invention, the method further comprises the processor queuing messages received from said computer communications network.

In another aspect of the present invention, the method further comprises sending information to said personal portable electronic device in response to said message.

In another aspect of the present invention, said information is one or more selected from the group comprising a digital image, a series of digitized images and digitized audio.

In another aspect of the present invention, said message is one or more selected from the group comprising a text message and an email.

In another aspect of the present invention, the method further comprises sending information to a web server.

In another aspect of the present invention, said information is one or more selected from the group comprising a digital image, a series of digitized images and digitized audio.

In another aspect of the present invention, the method further comprises the processor updating visual indicia in response to one or more messages received only from a single personal portable electronic device.

In another aspect of the present invention, the method further comprises the processor updating said visual indicia in response to a queued message sent from a second personal portable electronic device after an ending condition is met.

DETAILED DESCRIPTION OF PREFERRED EMBODIMENTS

The LED traffic light according to the present invention is an LED illuminated traffic light that is capable communicating to motorists approximately how much time remains before the traffic light changes from a signal directing motorists to proceed to a signal directing motorists to stop. Additionally, the LED traffic light according to the present disclosure is capable of disseminating important information such as traffic conditions and emergency instructions. Furthermore, the LED traffic light according to the present invention is also capable of displaying animated or still advertisements.

The LED traffic light according to the present disclosure can be vertically or horizontally aligned.

Figure 1:
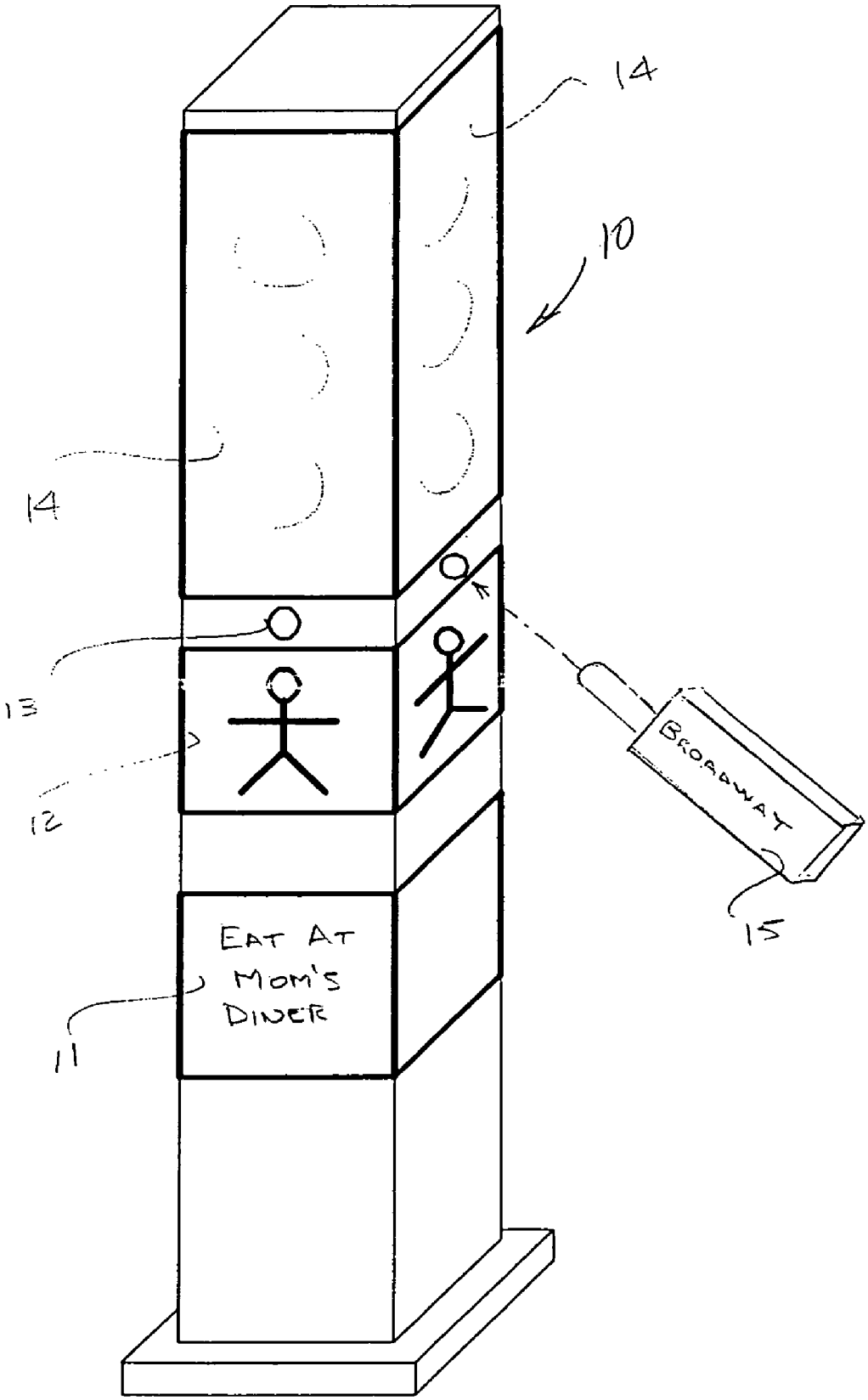
FIG. 1 shows an LED traffic light according to an embodiment of the present invention.

FIG. 1 illustrates a vertically aligned LED traffic light, in which the body 10 of the LED traffic light is a column or pillar, preferably a rectangular prism, and more preferably a rectangular prism with a square base and top and rectangular lateral sides. Preferably, the lateral sides are approximately 15 feet tall and the sides of the square top and bottom are approximately 15 inches wide. A base 16 can be attached to the bottom of the column 10 to increase the stability of the column. The base may be attached to the ground or floor, for example, by bolts, not shown. The base may also be attached to a foundation, for example, a cement foundation set below ground level.

The column 10 preferably has four lateral sides, but other configurations are possible such as a cylindrical prism having one continuous side or a triangular prism having three. The column must have one or more active surfaces. Active surfaces are lateral sides that contain LED panels. The column 10 has four active surfaces allowing the LED traffic light to control traffic in four directions at a four-way intersection.

According to one preferred embodiment of the present invention, mounted to each active surface of the column 10 is one primary LED traffic panel 14, one street sign receiving aperture 13, one pedestrian LED traffic panel 12 and one message LED panel 11. The invention is not limited to having one of each element, and various combinations are possible depending on the needs of the environment where the column 10 is installed.

The primary LED traffic panel 14 is preferably a low-resolution multicolored LED panel. This panel may also be formed from multiple smaller low-resolution multi-colored LED panels assembled together. For example, the primary LED traffic panel 14 can be constructed from combining 18 (9 rows of 2) light emitting diode dot matrix modules known as the 833 Intelligent Module (IM) manufactured by Desay Optotech Ltd. of Huizhou, China. The primary LED traffic panel 14 is responsible for controlling motor traffic and functions as a replacement for the conventional traffic light. The primary LED traffic panel 14 directs traffic by displaying an image on the panel's surface. The specific images that are displayed depend on the primary traffic panel display scheme used. Examples of primary traffic panel display schemes are described in detail below.

The street sign receiving aperture 13 allows for the attachment of a street sign 15. When a street sign 15 is attached, the LED traffic light also functions as a street sign. The street sign 15 may be a conventional pre-printed sign board or the street sign 15 may be an LED panel capable of displaying any programmed street name or other information like cross streets or building numbers. Even in embodiments of the present invention where the column 10 has four active surfaces, two street signs orthogonally oriented may be sufficient to convey street names.

The pedestrian LED traffic panel 12 is preferably a low-resolution LED panel, formed as a multicolored LED panel. This panel may also be formed from multiple smaller low-resolution multicolored LED panels combined in a single unit. For example, the pedestrian LED traffic panel 14 can be constructed by combining 6 (3 rows of 2) light emitting diode dot matrix modules known as the 08331M manufactured by Desay Optotech Ltd. of Huizhou, China. The pedestrian LED traffic panel 12 is responsible for directing pedestrian traffic and functions as a replacement for the conventional "walk/don't walk" pedestrian traffic signal. The pedestrian LED traffic panel 12 directs pedestrian traffic by displaying an image on the panel's surface. The specific images that are displayed depend on the pedestrian traffic panel display scheme used. Examples of pedestrian traffic panel display schemes are described in detail below.

The message LED panel 11 is preferably a high-resolution LED panel, such as a multicolored LED panel. This panel may also be formed from multiple smaller high-resolution multicolored LED panels combined as a single unit. For example, the message LED traffic panel 11 can be constructed from combining 12 (6 rows of 2) light emitting diode dot matrix modules known as the 0630IM manufactured by Desay Optotech Ltd. Of Huizhou, China. The message LED panel 11 is capable of displaying important information such as traffic conditions and emergency instructions. Additionally, the message LED panel 11 is capable of displaying full color high-resolution advertisements that may be animated or still.

Furthermore, the message LED panel 11, the pedestrian traffic panel 12, and the primary traffic panel 14 can all have the same resolution, as provided by the LED modules. Also, the locations on the body 10 of the message LED panel 11, the pedestrian traffic panel 12, and the primary traffic panel 14 are interchangeable. This can be done physically or by software. Alternatively, all three panels can be used as message boards.

Figure 2:
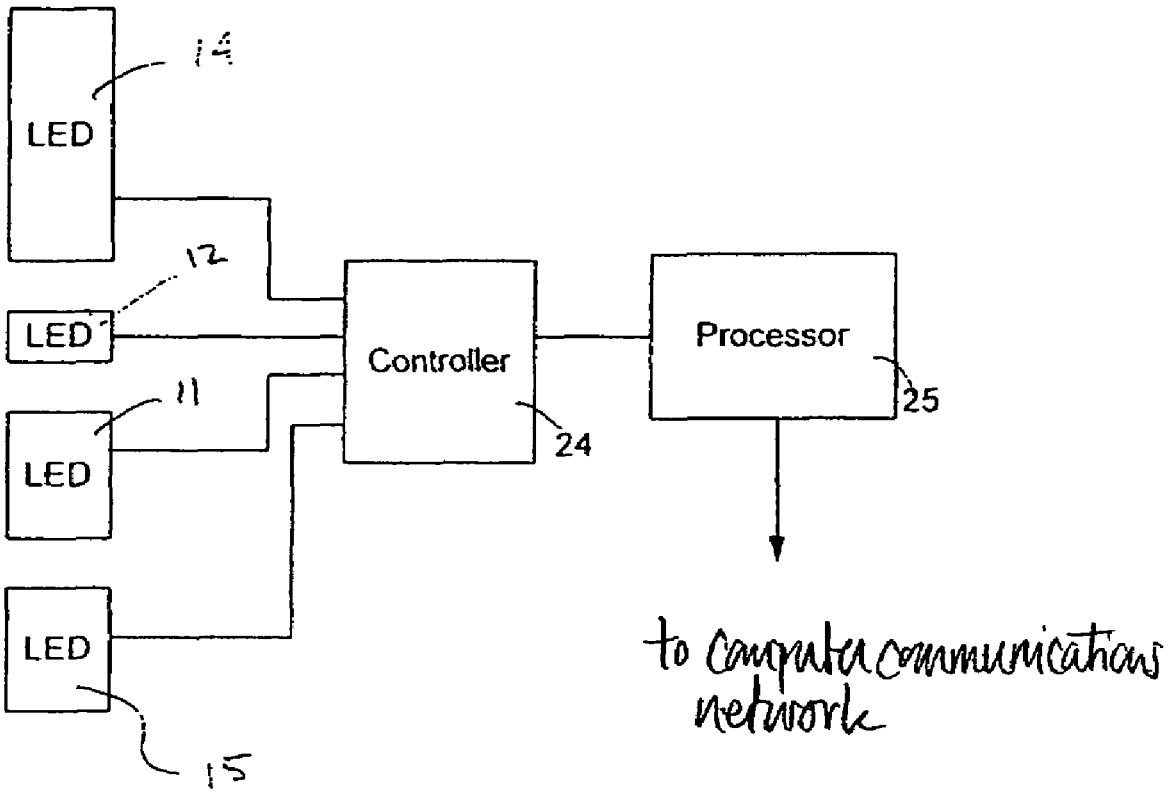
FIG. 2 is a block diagram of an LED control apparatus according to an embodiment of the present invention.

As shown in FIG. 2, the primary LED traffic panel 14, the pedestrian LED traffic panel 12 and the message LED panel 11 are all controlled by an LED panel controller 24. Additionally, when the street sign 15 contains an LED panel or other lighted element, the street sign 15 is also controlled by the panel controller 24. The panel controller 24 controls each LED on the LED panels according to instructions provided by a signal processor 25. The signal processor 25 may be a computer with a microprocessor, memory, storage device, such as a hard disk, and an interface for sending instructions to the panel controller 24. The signal processor 25 may also include other hardware necessary for controlling the LED panels 11, 12, 14, 15 and the controller 24. The signal processor may be located within of the column 10 or at a remote location.

The signal processor 25 runs a program for controlling the primary LED traffic panel 14 according to the primary LED traffic panel scheme, controlling the pedestrian LED traffic panel 12 according to the pedestrian LED traffic panel scheme and controlling the message LED panel 11 according to a message program as described below.

The signal processor 25 controls the primary LED traffic panel 14 according to the primary LED traffic panel scheme (primary scheme). This primary scheme defines what images the primary LED traffic panel 14 displays to direct traffic and the logic used to determine when to display the various defined images.

Figure 3A:
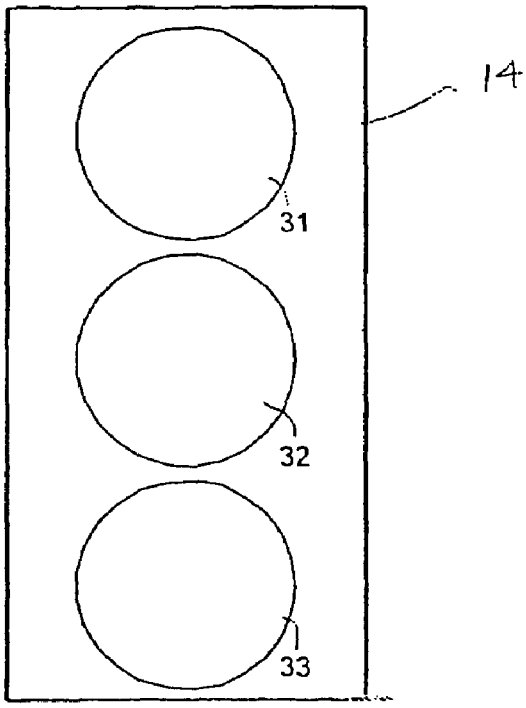
FIGS. 3A, 3B and 3C show primary LED traffic panel schemes according to an embodiment of the present invention.
Figure 3B:
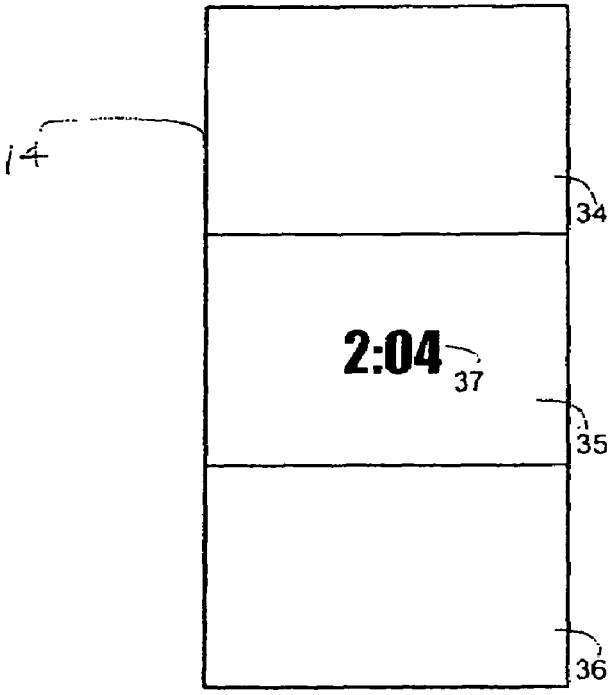
Figure 3C:
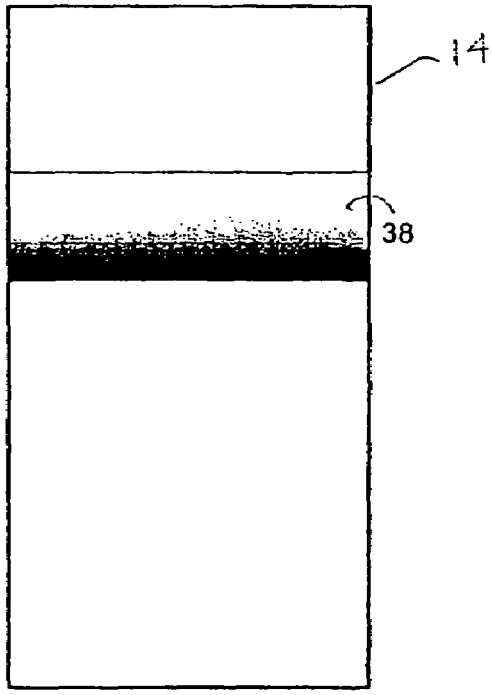

FIGS. 3A-3C illustrate several examples of primary schemes that can be used according to the current specification. The most basic primary scheme is illustrated in FIG. 3A, this is the conventional primary scheme for a traffic control light. According to this scheme, three circles are depicted representing the circles of a conventional traffic light. As with a conventional traffic light, when traffic is to be directed to proceed, the top circle 31 glows green. When traffic is to be informed of an impending red light, the center circle 32 glows yellow. When traffic is to be directed to stop, the bottom circle 33 glows red. Additionally, other traffic signals can be created, such as blinking yellow and blinking red signals, as desired. The conventional scheme includes the images to be displayed and the logic for directing traffic according to this scheme.

FIG. 3B illustrates an example of a modified conventional primary scheme. This scheme may be any scheme that preserves basic characteristics of the conventional scheme. For example, the conventional scheme may be modified to consist of three rectangles, as shown in FIG. 3B. These rectangles would act in the same way the three circles of the conventional primary scheme as illustrated in FIG. 3A and described above. For example, when traffic is to be directed to proceed, the top rectangle 34 glows green. When traffic is to be informed of an impending red light, the center rectangle 35 glows yellow. When traffic is to be directed to stop, the bottom rectangle 36 glows red.

Other modifications could include causing the entire primary LED panel to turn one solid color such as all red, all yellow, or all green to control traffic. Other modifications could incorporate the use of a count-down timer indicating how much longer the signal will remain the same until it is time to switch. For example, when the light is yellow, a timer in the form of black digital display 37 located in the center of the yellow light 35 can count down the time remaining until the light turns red. Another example would be the use of a stripe (not shown) either vertically or horizontally aligned that shrinks as the time until the next light change approaches. After the stripe has fully disappeared, the light changes. These count-down timers would give motorists greater opportunity to ascertain whether they should come to an immediate stop or continue through the intersection, thereby aiding the flow of traffic and increasing the safety of the intersection.

FIG. 3C illustrates an example of a gradient primary scheme. The gradient primary scheme calls for the illumination of only a horizontal strip 38. The strip begins at the top of the LED panel where the gradient is colored green. The strip then moves downward illuminating a color that is increasingly yellow and decreasingly green until the strip is half-way down the LED panel and fully yellow. At this point the strip continues to move downward illuminating a color that is increasingly red and decreasingly yellow. When the strip has reached the bottom of the LED panel, it is fully red. Then a clear signal is sent indicating that traffic is directed to stop. For example, the strip may disappear and the entire rectangle will turn red. The use of this timed gradient allows motorists greater opportunity to ascertain whether they should come to an immediate stop or continue through the intersection, thereby aiding the flow of traffic and increasing the safety of the intersection.

The pedestrian LED traffic panel 12 is controlled according to the pedestrian LED traffic panel scheme (pedestrian scheme). This pedestrian scheme defines what images the pedestrian LED traffic panel 12 displays to direct traffic and the logic used to determine when to display the various defined images. The conventional pedestrian scheme illustrates a white stick figure of a person walking indicating that pedestrian traffic may cross the street. A red stick figure of a person standing still indicates that pedestrian traffic may not cross the street. The animated pedestrian scheme uses figures similar to the conventional pedestrian scheme, however, the stick figures are animated to greater clarify the intent of the signal. For example, when pedestrian traffic is directed to proceed with crossing the street, a white stick figure person may have legs that move to indicate walking. Animation need not be limited to the walking signal, for example, when pedestrian traffic is directed to refrain from crossing the street, a red stick figure person might be shown to repeatedly tap one foot to illustrate waiting. Additionally, the timer features discussed above may be incorporated into the pedestrian scheme. For example, a count-down timer might accompany the walking stick figure.

A message program is used to control the message LED panel 11 according to the present invention. The message program runs on the signal processor 25, and the signal processor 25 is connected to a computer communications network such as the Internet or a wide area network, as shown in FIG. 2. The signal processor 25 may be connected to the computer communications network via a standard telephone line, a DSL line, a fiber-optic line, a coaxial cable or any other form of wired connection. Alternatively, the processor 25 may be connected to the computer communications network via a wireless connection, such as a wireless connection over a digital cellular telephone network or a wireless local area network connection, such as a wireless connection conforming to IEEE 802.1b or 802.11 (e.g. 802.11a, 802.11b, 802.11g, and 802.11n). The connection into the computer communications network described above (hereinafter "computer communications network connection") may be over the Internet using a secure method of communication such as encryption and/or a secure virtual private network (VPN). Using the computer communications network connection, the municipality or contracted administrator may modify the message program to update messages or to install animated advertisements. The message program determines what messages are displayed on the message LED panel 11. The message LED panel 11 is also capable of disseminating important information such as traffic conditions and emergency instructions. For example, text can be displayed indicating that poor traffic conditions are ahead and advising motorists of alternative routes or information to motorists to be on the lookout for a particular vehicle suspected of transporting a fugitive. Text can be displayed all at once or text may scroll across the panel. The message program is capable of receiving any manner of message from the computer communications network.

In order to increase municipal revenue, municipalities may choose to run advertisements on the message LED panel 11. Because the message LED panel 11 is high resolution, television-style advertisements can be displayed. These advertisements can be tailored for the particular community in which the traffic light is installed, thereby increasing the value of the advertisement. The advertisements can be regularly updated over the computer communications network connection.

Figure 5:
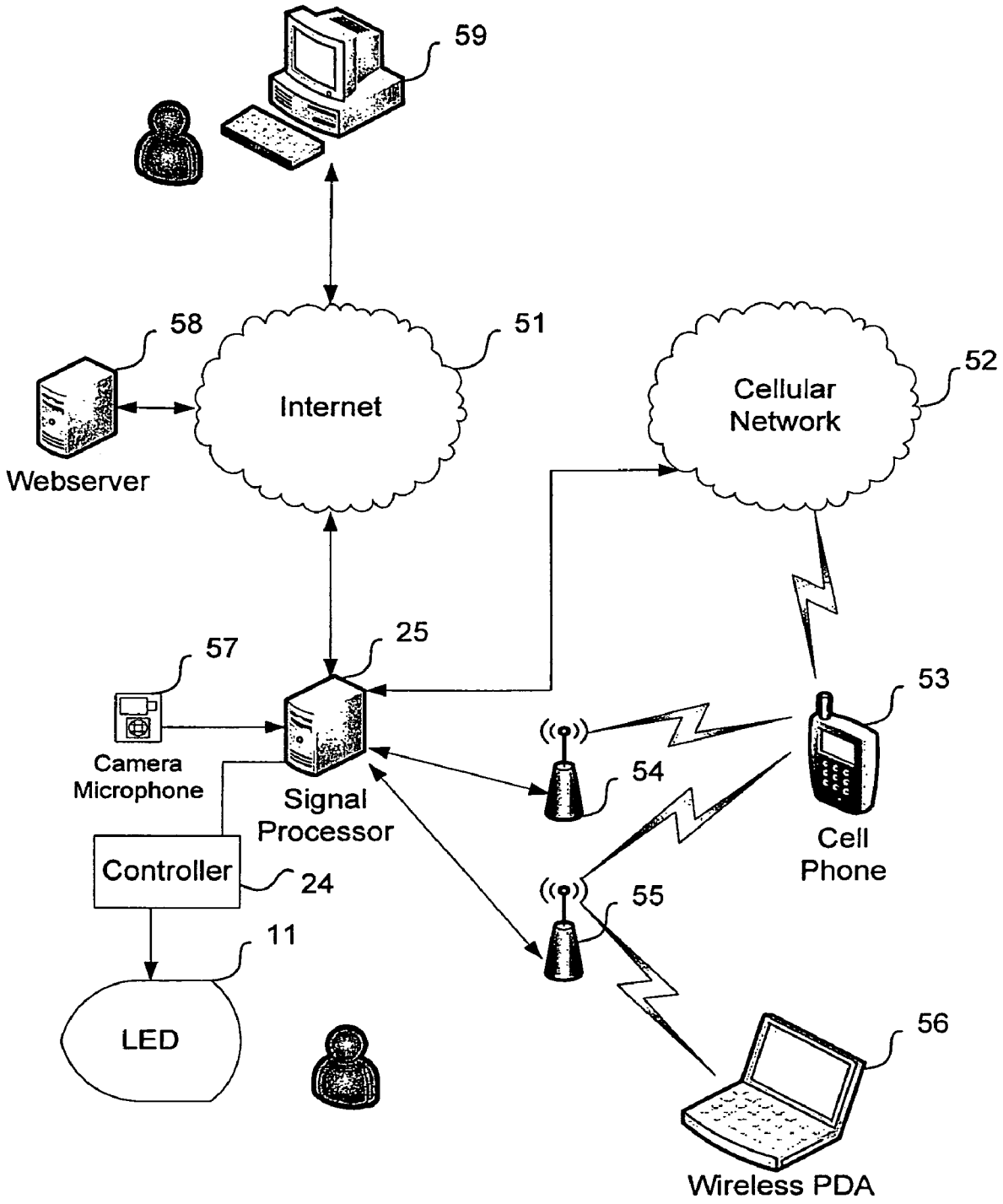
FIG. 5 is a schematic diagram that illustrates an embodiment of the invention for additional uses of a messaging board.

FIG. 5 illustrates an embodiment of the invention for additional uses of the message board 11 in the LED traffic light. As shown in FIG. 5 and previously mentioned above in connection with FIG. 2, signal processor 25 is coupled to a computer communications network such as the Internet 51. Signal processor 25 may also be coupled to a cellular network 52 and function as a cellular phone transmitter or relay station for a cellular telephone 53 via cellular phone antenna 54. Signal processor 25 may also be adapted to serve as a wireless internet transmitter station or hot spot via access point 55. A portable laptop, personal digital assistant (PDA), or other personal portable electronic devices 56 can connect to the Internet 51 through access point 55. Access point 55 may support 802.11 wireless public networking, Bluetooth, or any other wireless or infrared technologies known in the art. Signal processor 25 can be adapted to include audio and or video surveillance equipment 57 to assist in law enforcement, emergency response or advertising. Thus, the LED traffic light can also be adapted to include a stationary or mobile webcam, live cam, or other digital audio and/or video equipment (represented by camera microphone 57) which records and/or broadcasts real-time audio and/or video of its surrounding location to other LED traffic lights nearby or in other cities, or on a website 58 via Internet 51.

Additionally, an emergency motif can be used to warn motorists and pedestrians to move to the curb or stay on the sidewalk in the event of an oncoming emergency vehicle.

The LED traffic light according to the present invention has the added advantage of being easily configurable to display a holiday or festive motif. To implement such a motif, the utilized schemes can be modified to display timely festive accents on one or more LED panels. The use of specialized motifs is not limited to holidays and festivals, motifs can be used to modify the appearance of LED traffic lights in accordance with the cultural or historic significance of the neighborhood or area in which the LED traffic light is located.

Figure 4:
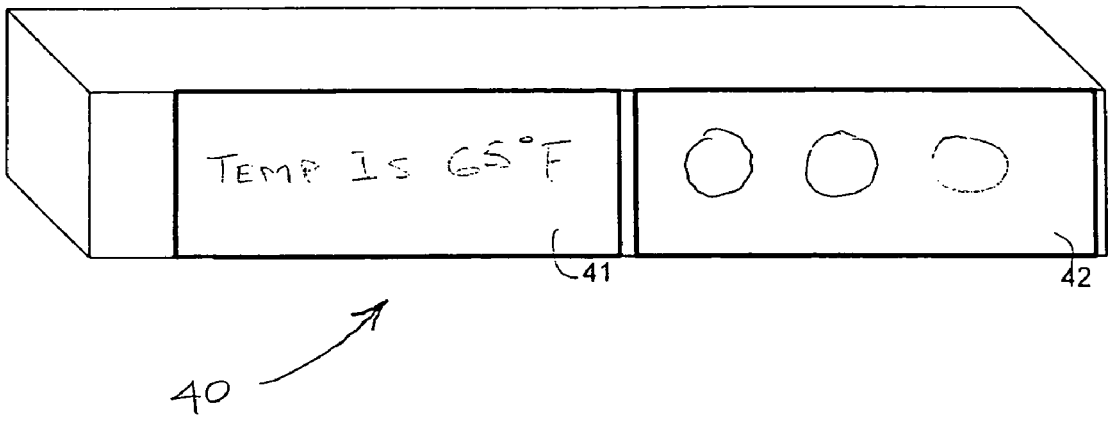
FIG. 4 shows another embodiment of LED traffic light according to the present invention.

The LED traffic light according to the present invention is not limited to a vertical column configuration. For example, the LED traffic light may be horizontally oriented. FIG. 4 illustrates an embodiment of the present invention where the LED traffic light is horizontally oriented. According to one example of a horizontal orientation, the traffic light 40 is held over the intersection by cables or attached to one or more support columns. The primary LED traffic panel 42 directs traffic while the message LED panel 41 displays a message or advertisement. A pedestrian LED traffic panel (not shown) and/or a street sign (not shown) may also be included in horizontal embodiments. In another example, the LED traffic light may be oriented in a L-shaped, a hook-shaped, a chair-shaped, a bench-shaped, a steeple-shaped, or a zig-zag-shaped configuration by arranging the message LED panel 11, the pedestrian LED traffic panel 12, and the primary traffic panel 14 either 45° or 90° relative to each other.

In another embodiment of the present invention, the LED traffic light allows a user in visual and communications proximity of message LED panel (or LED message board) 11 to interact with the device to obtain information, products and/or other services. Multiple users may interact with the device simultaneously or sequentially, for example, on a first-come, first-served basis. As an example, when the device is being used by a particular user, messages sent by other users may be queued by signal processor 25. The device may respond only to messages sent by a current user, until an ending condition, such as a message transmitted by a user or the mere passage of time, allows the device to respond to the next message received by another user that is stored in the queue. As noted above and illustrated in FIG. 5, signal processor 25 is connected to Internet 51. Either access point 55, cellular antenna 54 or an interface to a cellular telephone network 52 or communications through Internet 51 can provide a proximal user to communicate with signal processor 25 and affect the output of LED message board 11. Proximal users of personal portable electronic devices, such as cellular phone 53, PDA/wireless laptop 56, handheld email browsers, MP3 players, digital cameras or other electronic devices with wireless communications capabilities (not shown) may interface with signal processor 25, either directly or via Internet 51 or cellular network 52, using emails, SMS text messages, or other types or formats of messages as well known in the art. To communicate with the LED traffic light, the proximal user may need to register on a website and/or download a program into the personal portable electronic device, or authenticate via web server 58 as is well known in the art. In a preferred embodiment, signal processor 25 or web server 58 provides two-way communications with the personal portable device. In this way, LED message board 11 can be used as, for example, an information terminal. As an information terminal, using his/her personal portable electronic device (e.g., PDA 56), a proximal user may request information, such as directions to a particular event or address, advertisements, promotions, play games, or request other visual output from LED message board 11. Alternatively, signal processor 25 may receive requests from a proximal user and send back requested information directly to his/her PDA 56 or other personal portable electronic device while providing instructions to obtain information on LED message board 11. Such information may be stored in signal processor 25 or may be obtained from web server 58 or Internet 51.

As noted above, the LED traffic light may also provide a cellular phone transmitter or relay station or a wireless internet transmitter, thus allowing a user with a wireless laptop computer or a web-enabled cellular phone to directly access the Internet, if desired.

In addition, the LED traffic light may be used as a self-service electronic point-of-sales station. For example, the local user may use a Bluetooth®-enabled personal portable electronic device, such as a cellular phone, to access the LED traffic light to purchase tickets for a theater show advertised on the LED message board 11.

As discussed above and illustrated in FIG. 5, a municipality or administrator may modify the message program or install animated advertisements using a computer 59 connected to the Internet 51, for example. In addition, individuals or businesses that advertise using the LED traffic light may also modify or update their advertisements via Internet 51 or by interacting directly with LED traffic light using a personal portable electronic device (e.g., PDA 56; cell phone 53), or through some alternative computer communications network or cellular telephone network 52. This feature may be particularly useful for local advertisers who will be able to modify or update their advertisements based on local pedestrian traffic, for example, or based on pedestrian's digital interaction with the LED traffic light, as instructed by its LED message board 11. Furthermore, LED traffic lights may be designated as digital bulletin boards, enabling users to post information or "digital flyers" regarding upcoming local community events.

Figure 6:
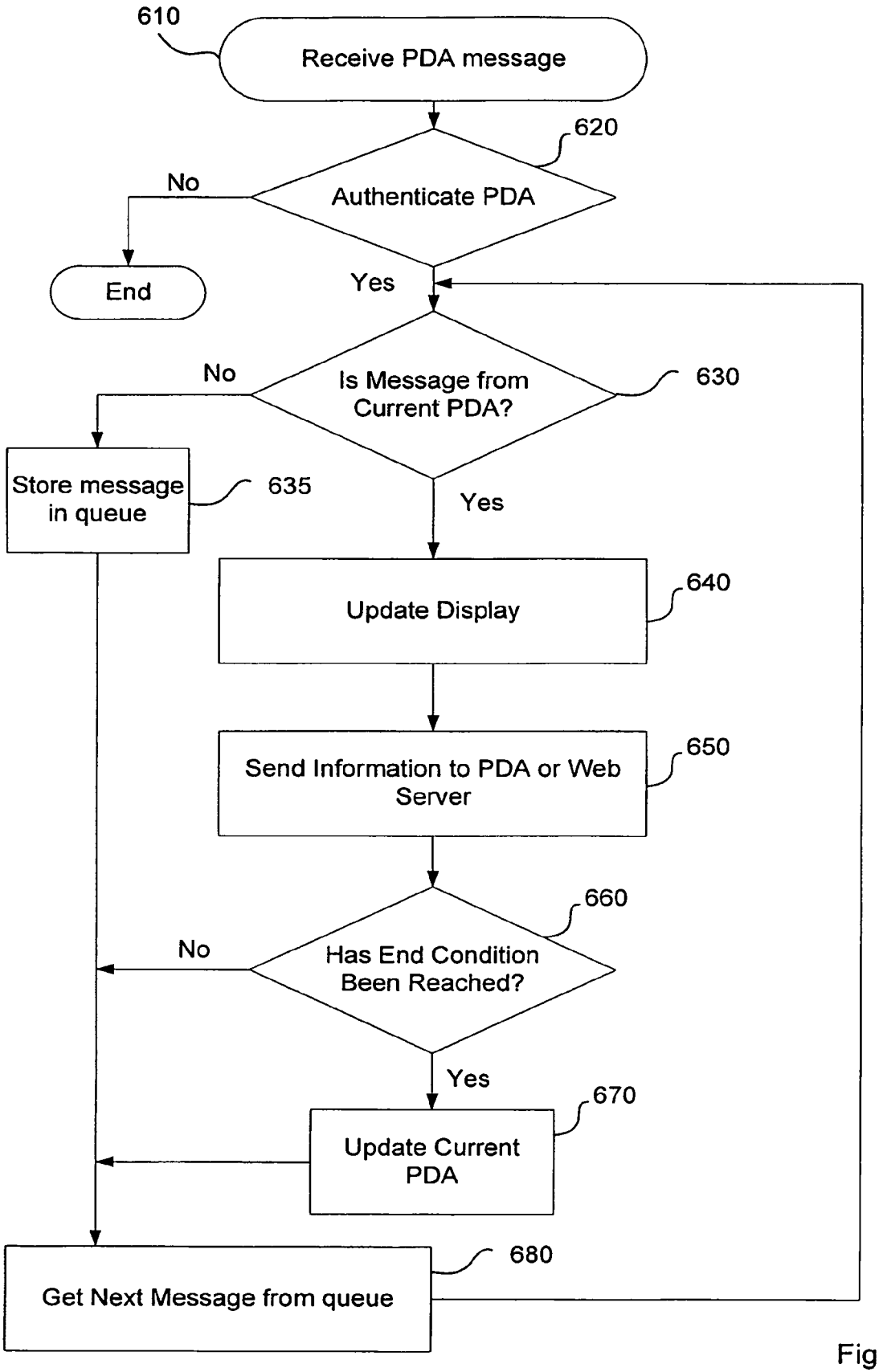
FIG. 6 is a flow chart that illustrates an method for interacting with a messaging board.

FIG. 6 is a flow chart that illustrates a method for interacting with a messaging board. As shown in FIG. 6, at step 610, the system receives a wireless message from a PDA. Alternatively, the system may receive the message from the Internet. As explained above, the message may be an email, text message, or some other form of digital communication as is well known in the art.

In a preferred embodiment, illustrated in step 620, the system authenticates the identity of the PDA user using the identification information contained in the message. In an alternate embodiment, the system will query the user for further information in order to verify that the user has the proper credentials to interact with the system. This step is optional, as the system is designed for unfettered public use. However, different users may be permitted to perform different functions, depending upon their authenticated identity, thus authentication may ensure that unauthorized tampering occurs. If authentication is required, unauthenticated user messages are discarded.

In step 630, the system examines the message sent to it to determine if the PDA sending the message is at the front of the line for interaction with the message board. If not, in step 635 the user's message is stored in a queue for later processing. However, if the user is the current user interacting with the system, processing proceeds to step 640 where the system updates the visual indicia on LED message board 11 in response to the message. Exemplary updates were illustrated in the preceding paragraphs.

Optionally, in step 650, the system generates a message responsive to the user's message. The responsive message might contain data from a peripheral device attached to the system, for example, digital audio or video, and send that information back to a web server for viewing through the Internet. The system may alternatively send the information directly to the user's PDA. In this fashion, point-of-sale transactions could be conducted.

In step 660, the system checks to see if an ending condition has been reached. This check is necessary to ensure that a particular user does not monopolize the resources provided by the messaging board system. Such condition comprises the passage of time or a particular limit on the, number of user messages processed, for example. If the end condition has been reached, in step 670 the identity of the current user is updated to the next user waiting in line.

In step 680, the next message in the queue is retrieved. Processing loops back to step 630, where that message is checked to see if it came from the current user.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An interactive bulletin board system, comprising:

a signal processor coupled to a computer communications network;

a messaging board coupled to said signal processor, said messaging board providing visual indicia responsive to said signal processor;

a personal portable electronic device wirelessly coupled to said computer communications network; and a primary traffic panel directly coupled to said messaging board, said primary traffic panel including a first matrix of multicolored LEDs, said primary traffic panel directing motor traffic, wherein said signal processor updates said visual indicia displayed on said messaging board in response to a message sent from said personal portable electronic device to said signal processor, and wherein said interactive board system is a column with at least three lateral sides, and wherein a plurality of said lateral sides comprise said messaging board and said primary traffic panel.

2. The interactive bulletin board system of claim 1, wherein said messaging board comprises a second matrix of multicolored LEDs.

3. The interactive bulletin board system of claim 1 or 2, wherein said visual indicia represents information requested through the personal portable electronic device.

4. The interactive bulletin board system of claim 3, wherein said information is obtained from the Internet.

5. The interactive bulletin board system of claim 4, wherein said signal processor authenticates said personal portable electronic device before updating said visual indicia.

6. The interactive bulletin board system of claim 1 or 2, wherein said personal portable electronic device comprises a device selected from the group comprising a cellular phone, a wireless laptop, a handheld email browser, an MP3 player and a digital camera.

7. The interactive bulletin board system of claim 6, further comprising a camera coupled to said signal processor, wherein said visual indicia comprises images provided by said camera.

8. The interactive bulletin board system of claim 1 or 2, wherein said signal processor responds to messages sent from more than one personal portable electronic device.

9. The interactive bulletin board system of claim 8, wherein said signal processor responds sequentially to messages received from more than one personal portable electronic device.

10. The interactive bulletin board system of claim 9, wherein said signal processor responds to messages received from only a single personal portable electronic device until an ending condition is met.

11. An interactive bulletin board system, comprising:

a signal processor coupled to a computer communications network;

a messaging board coupled to said signal processor, said messaging board providing visual indicia responsive to said signal processor;

a personal portable electronic device wirelessly coupled to said computer communications network;

a primary traffic panel including a first matrix of multicolored LEDs, said primary traffic panel directing motor traffic; and a spacer directly coupled between said messaging board and said primary traffic panel, wherein said signal processor updates said visual indicia displayed on said messaging board in response to a message sent from said personal portable electronic device to said signal processor, and wherein said interactive board system is a column with at least three lateral sides, and wherein a plurality of said lateral sides comprise said messaging board and said primary traffic panel.

12. The interactive bulletin board system of claim 1, 2 or 11, wherein said column is triangular or rectangular.

* * * * *

UNITED STATES PATENT AND TRADEMARK OFFICE

CERTIFICATE OF CORRECTION

PATENT NO. : 7,667,617 B2
APPLICATION NO. : 11/510365
DATED : February 23, 2010
INVENTOR(S) : Teddy Yeung Man Lo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 675 days.

Signed and Sealed this

Seventh Day of December, 2010

David J. Kappos

David J. Kappos
*Director of the United States Patent and Trademark Office*